US012366045B2

(12) United States Patent
Grahek et al.

(10) Patent No.: US 12,366,045 B2
(45) Date of Patent: Jul. 22, 2025

(54) INTEGRATED OUTER WHEEL ASSEMBLY

(71) Applicant: Caterpillar Inc., Peoria, IL (US)

(72) Inventors: Robert J. Grahek, Washington, IL (US); Nicholas J. Fayville, New Underwood, SD (US)

(73) Assignee: Caterpillar Inc., Peoria, IL (US)

( * ) Notice: Subject to any disclaimer, the term of this patent is extended or adjusted under 35 U.S.C. 154(b) by 856 days.

(21) Appl. No.: 17/523,398

(22) Filed: Nov. 10, 2021

(65) Prior Publication Data

US 2023/0141668 A1 May 11, 2023

(51) Int. Cl.
*E02D 3/026* (2006.01)

(52) U.S. Cl.
CPC ..... *E02D 3/0265* (2013.01)

(58) Field of Classification Search
CPC ..... E02D 3/0265
USPC ..... 404/124, 128
See application file for complete search history.

(56) References Cited

U.S. PATENT DOCUMENTS

| | | | | |
|---|---|---|---|---|
| 5,511,901 | A * | 4/1996 | Yates | E01C 19/236 404/124 |
| 6,095,717 | A | 8/2000 | Kaldenberg et al. | |
| 6,390,204 | B1 | 5/2002 | Schafle | |
| 7,731,307 | B1 * | 6/2010 | Freeman | B60B 7/00 172/508 |
| 8,333,439 | B2 | 12/2012 | Gibbins | |
| 8,690,475 | B2 | 4/2014 | Springer | |
| 8,821,065 | B2 * | 9/2014 | Ugru | B60B 15/24 404/124 |
| 11,077,534 | B2 | 8/2021 | Brockway | |
| 12,018,440 | B2 * | 6/2024 | Meier | E01C 21/00 |
| 2012/0213586 | A1 | 8/2012 | Ugru | |
| 2014/0062166 | A1 * | 3/2014 | Crystal | E02D 3/0265 301/43 |
| 2018/0250787 | A1 | 9/2018 | Brockway | |

OTHER PUBLICATIONS

Written Opinion and International Search Report for Int'l. Patent Appln. No. PCT/US2022/079427, mailed Feb. 24, 2023 (13 pgs).

* cited by examiner

*Primary Examiner* — Gary S Hartmann

(57) ABSTRACT

An integrated outer wheel assembly for a compactor vehicle has a hollow cylindrical wrapper, and the wrapper has an inboard side and an outboard side. The wrapper further has one or more tips on an outer surface of the wrapper. The integrated outer wheel assembly is secured to a wheel core.

17 Claims, 6 Drawing Sheets

INTEGRATED OUTER WHEEL ASSEMBLY

TECHNICAL FIELD

The present disclosure generally relates to a compactor wheel for a compactor vehicle, and more specifically, to an integrated outer wheel assembly for the compactor wheel.

BACKGROUND

Compactor vehicle wheels are produced as a single steel weldment having a hub ring attached to two radially projecting conical members, an outer wrapper, and up to 40 tips attached to the outer wrapper. The compactor wheels are assembled in the order listed from innermost out. The outer wrapper and tips are the primary wear components as they contact the material being compacted by the compactor vehicle. The compactor wheel reconditioning process entails removal of the tips and the outer wrapper. The tips and the outer wrapper are cut from the compactor wheel using an acetylene torch. Installing a new outer wrapper involves rolling heavy plate into an open cylinder, lowering it over the two radially projecting conical members being reused, welding the open wrapper plate together, and welding it in place before welding on new tips.

U.S. Pat. No. 8,690,475 relates to a compaction apparatus that has a removable plate used to cover an outermost arcuate surface of a wheel of a compactor vehicle. The plate defines a plurality of ports, with each port used to receive at least a portion of a base of a compactor wheel projection.

While effective, there remains a need for improved compactor wheels for compactor vehicles used in high wear applications, such as the waste industry.

SUMMARY

In accordance with the present disclosure, an integrated outer wheel assembly for a compactor vehicle is disclosed. The outer wheel assembly has a hollow cylindrical wrapper, and the wrapper has an inboard side and an outboard side. The wrapper may have hard facing on a circumferential edge of the wrapper, and also has one or more tips on an outer surface of the wrapper. The integrated outer wheel assembly is secured to a wheel core.

In accordance with another aspect of the present disclosure, a compactor wheel for a compactor vehicle is disclosed. The compactor wheel has a wheel core which has a circumference defined by an inboard side and an outboard side of the wheel core. The compactor wheel also has an integrated outer wheel assembly that is secured to the wheel core. The integrated outer wheel assembly has a hollow cylindrical wrapper that has an inboard side and an outboard side. The wrapper may have a hard facing on a circumferential edge of the wrapper and one or more tips on an outer surface of the wrapper. The integrated outer wheel assembly is secured to the wheel core by positioning the integrated outer wheel assembly over the circumference of the wheel core and securing the integrated outer wheel assembly to the wheel core by joining at a first interface of the inboard side of the wheel core and the inboard side of the wrapper and joining at a second interface of the outboard side of the wheel core and the outboard side of the wrapper.

In accordance with a further aspect of the present disclosure, a method of remanufacturing a compactor wheel of a compactor vehicle is disclosed. The method includes providing a wheel core. The wheel core has an inboard conical member and an outboard conical member, with a circumference of the of inboard conical member and a circumference of the outboard conical member defining a circumference of the wheel core. The method further includes positioning an integrated outer wheel assembly over the circumference of the wheel core. The integrated outer wheel assembly has a hollow cylindrical wrapper which has one or more tips on an outer surface of the wrapper, an inboard side and an outboard side, and may have hard facing on a circumferential edge of the wrapper. Further, the method includes securing the integrated outer wheel assembly to the wheel core by joining at a first interface of the inboard conical member and the inboard side of the wrapper and joining at a second interface of the outboard conical member and the outboard side of the wrapper.

These and other aspects and features of the present disclosure will be more readily understood when read in conjunction with the accompanying drawings.

DETAILED DESCRIPTION

Figure 1:
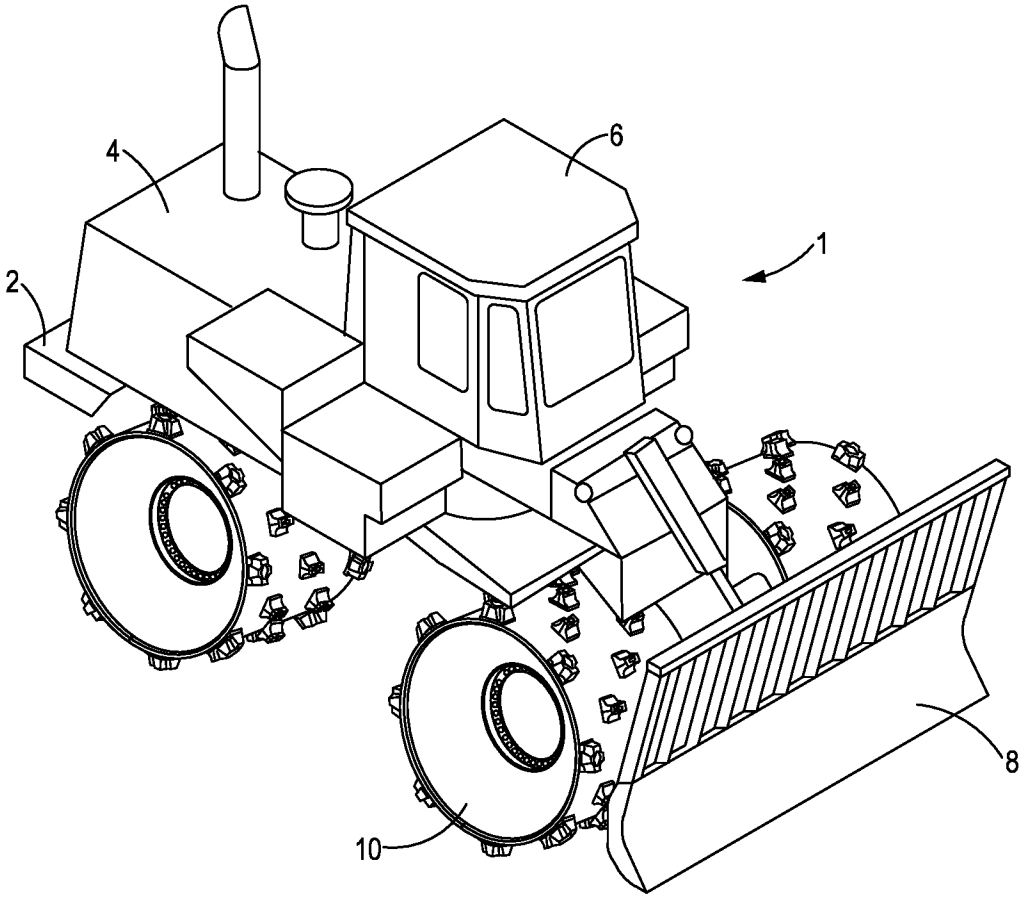
FIG. 1 is perspective view of an exemplary compactor vehicle, in accordance with the present disclosure.

A compactor vehicle, specifically a landfill compactor vehicle, is shown broadly at reference numeral 1 in FIG. 1. The compactor vehicle 1 includes a frame 2, an engine 4 supported on the frame 2, a cab 6 supported on the frame 2, and a plow 8 attached to the frame. The compactor vehicle 1 further includes a plurality of compactor wheels 10 for compacting waste in a landfill as the compactor vehicle 1 drives over the waste.

Figure 2:
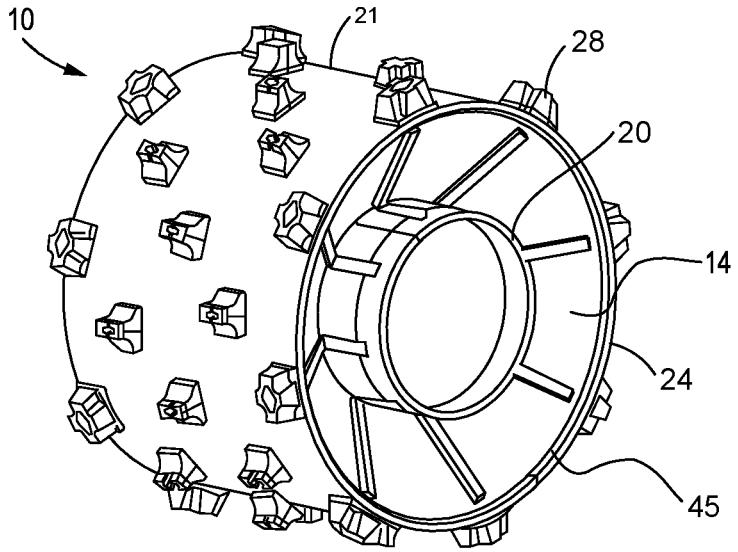
FIG. 2 is a perspective view of the inboard side of a compactor wheel of the compactor vehicle of FIG. 1, in accordance with the present disclosure.
Figure 3:
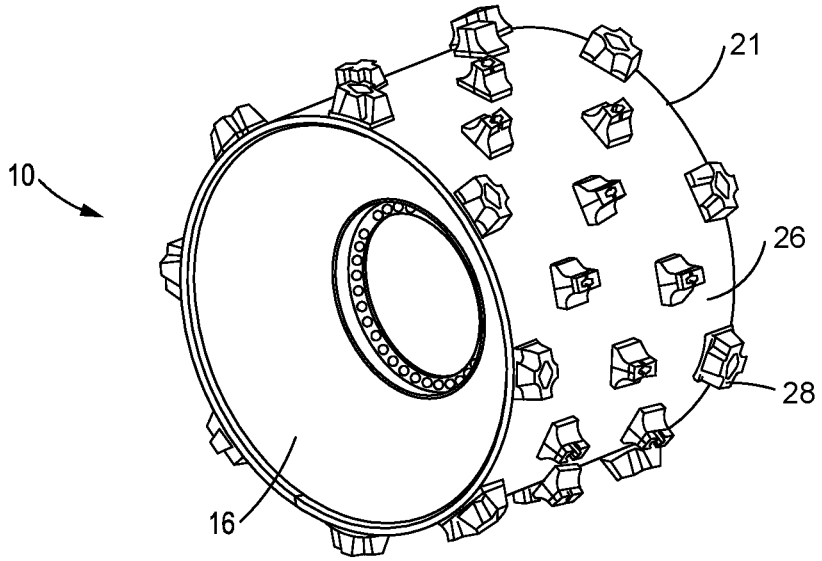
FIG. 3 is a perspective view of the outboard side of the compactor wheel of FIG. 2, in accordance with the present disclosure.
Figure 4:
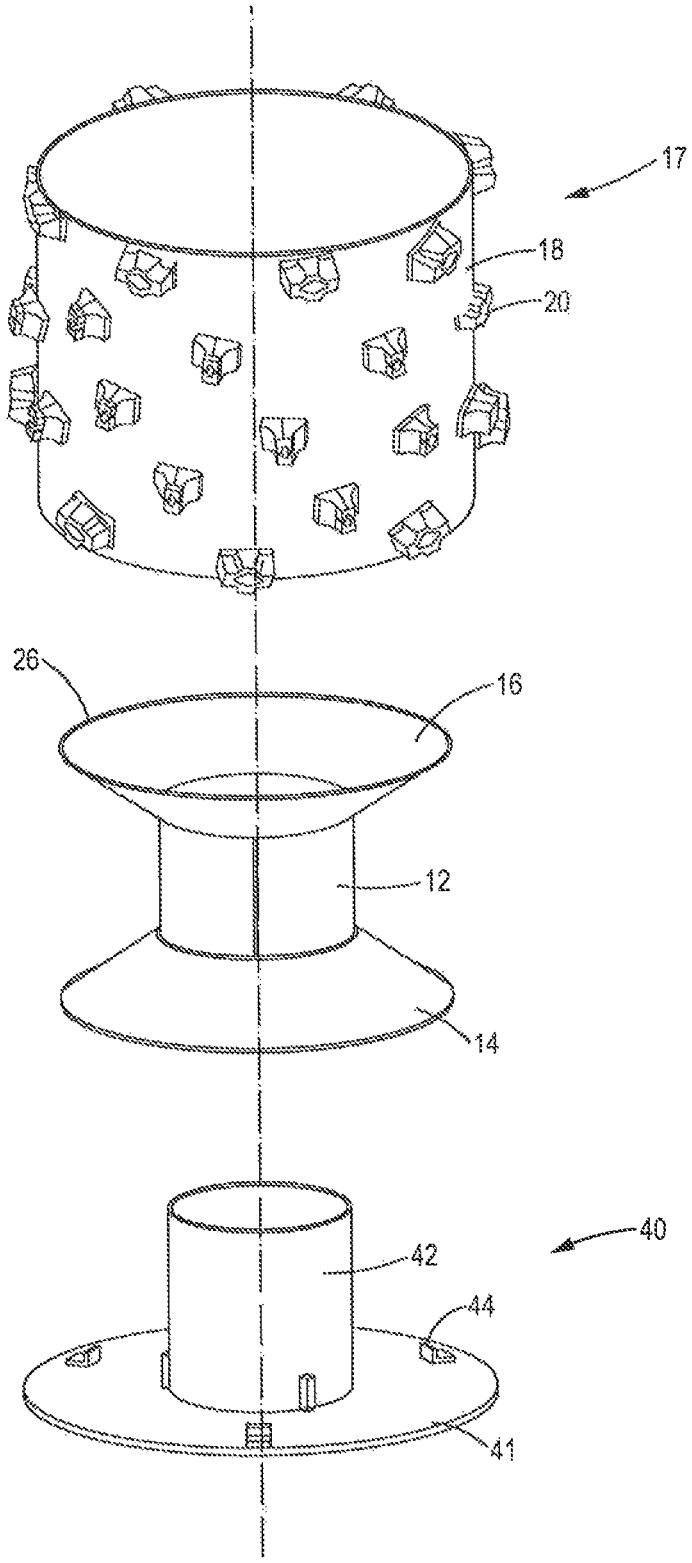
FIG. 4 is perspective view of an integrated outer wheel assembly and a wheel core of the compactor wheel of FIG. 2 positioned over a wheel fixture, in accordance with the present disclosure.

Turning to FIGS. 2 and 3, the inboard side of the compactor wheel 10 is shown in FIG. 2, and the outboard side of the compactor wheel 10 is shown in FIG. 3. The inboard side being the side of the compactor wheel 10 that faces the frame 2, or axle (not shown), of the compactor vehicle 1, and the outboard side being the side of the compactor wheel 10 that faces away from the frame 2, or axle, of the compactor wheel when the compactor wheels 10 are attached to the compactor vehicle 1. As best shown in FIG. 4, the compactor wheel 10 is formed of a wheel core 11 secured to an integrated outer wheel assembly 12.

The wheel core 11 has a rim core 13 attached to an inboard conical member 14 and an outboard conical member 16. The rim core 13 and the attached inboard and outboard conical members 14, 16 form a single piece weldment, and is formed of a metal material. The rim core 13 is a hollow, or in another exemplary embodiment, solid, cylindrical member. The inboard conical member 14 has an inboard conical member circumference 17 encircling the outermost edge, away from the rim core 13, of the inboard conical member 14. The outboard conical member 16 has an outboard conical member circumference 18 encircling the outermost edge, away from the rim core 13, of the outboard conical member 16. The inboard conical member circumference 17 and the outboard conical member circumference 18, in one exemplary embodiment, are equal in size, or substantially equal, and define a circumference of the wheel core 19. Further, the rim core 13, as shown in FIG. 2, may have a rim extension 20 to cover the axle of the compactor vehicle 1 to keep debris out.

The integrated outer wheel assembly 12 is integrated, or one-piece, with the integrated outer wheel assembly being pre-fabricated before being secured to the wheel core 11 to form the compactor wheel 10. The integrated outer wheel assembly 12 has a hollow cylindrical wrapper 21, and in one exemplary embodiment, the wrapper 20 is a one piece hollow cylinder made of metal, such as steel. The wrapper 21 may have a thickness of 0.001 to 4 inches, an outer wrapper diameter 21 of 10 to 100 inches, and a width of 10 to 100 inches. In this exemplary embodiment, the wrapper 21 has a wrapper circumference 23 that is larger than the circumference of the wheel core 19, allowing wrapper 21 to be placed over the wheel core 11 before being secured to form the compactor wheel 10. As best shown in FIGS. 2 and 3, the wrapper 21 further has a wrapper inboard side 24 and a wrapper outboard side 25 that are configured to be adjacent to the inboard conical member 14 and outboard conical member 16, respectively, when the integrated outer wheel assembly 12 is secured to the wheel core 11 to form the compactor wheel 10.

On an outer surface of the wrapper 26 are a plurality of tips 28. The tips 28 are projections made of metal and attached to the outer surface of the wrapper 26 by using any one of a variety of methods, including welding and bolting. The tips 28 are configured to compact waste as the compactor wheels 10 drive over the waste in a landfill, and are also configured to provide traction to the compactor vehicle 1. In one exemplary embodiment, there are 5 rows of 8 tips on the outer surface of the wrapper 26. In another exemplary embodiment, there are 35 tips 28. In a further embodiment, the outer surface of the wrapper 26 has one or more tips 28 that are placed in any predetermined pattern configured to provide traction to the compactor vehicle 1 or compact waste in a landfill.

Figure 5:
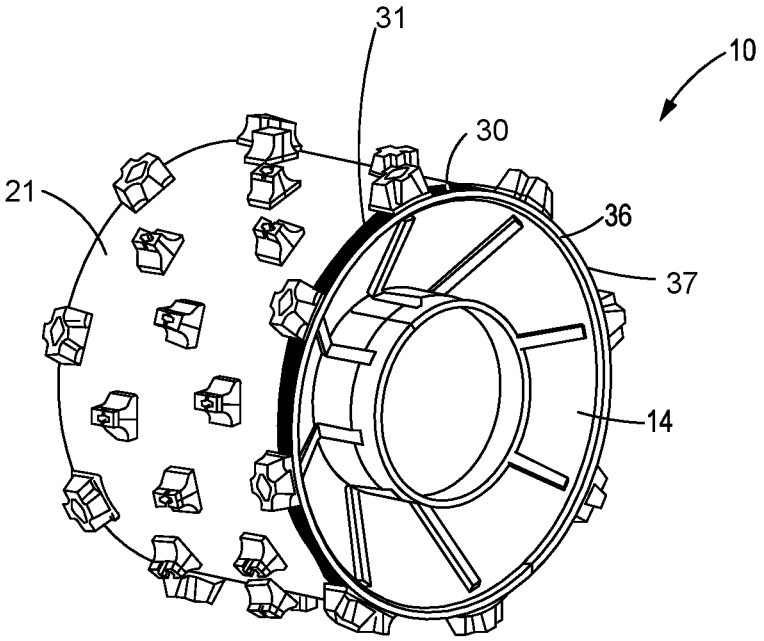
FIG. 5 is a perspective view of the compactor wheel of FIG. 2 having hard facing, in accordance with the present disclosure.
Figure 6:
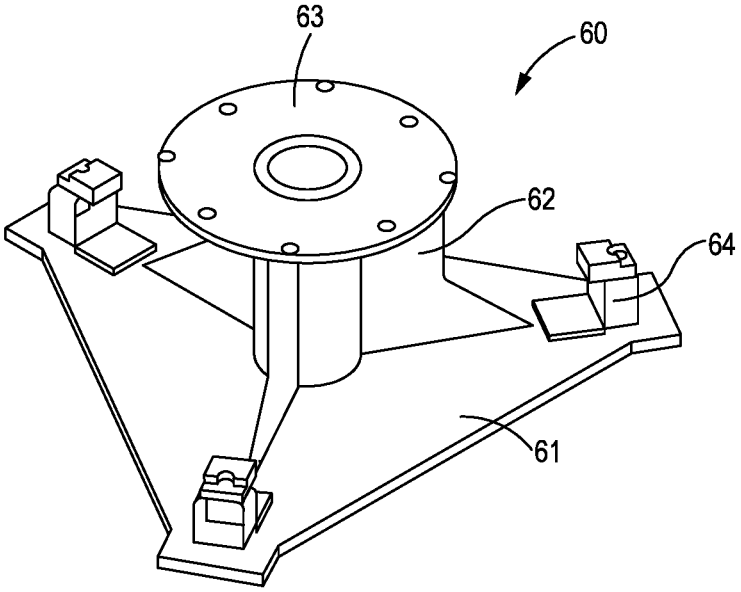
FIG. 6 is an exemplary wheel fixture, in accordance with the present disclosure.

As best shown in FIG. 5, a hard facing 30 is applied to the integrated outer wheel assembly 12, and specifically, is applied to a circumferential edge 31 of the wrapper 21. To counter wear on the wrapper inboard side 24, the hard facing 30 is applied, such as a surface treatment, to the circumferential edge 31 of the wrapper 21 to reinforce the circumferential edge 31 and thus provide increased wear resistance and serviceable life. For example, the coating may be extruded, welded, plasma flame sprayed, or otherwise coated across the circumferential edge 31. The entire outer surface of the wrapper 26 need not be hard faced, but rather the circumferential edge 31 to allow for even wear across the width of the compactor wheel 10. In one exemplary embodiment, the hard facing procedure involves applying melted metal, or melted weld wire, directly to the circumferential edge during the fabrication on the integrated outer wheel assembly 12. The hard facing material, such as the mentioned metal or melted weld wire, may have a metal hardness that is harder than the metal hardness of the wrapper 21, and thus is a harder more wear resistant metal than the metal used to construct the wrapper 21. For example, the wrapper 21 may be constructed of a first metal and the hard facing is a weld applied surface treatment of a second metal, with the second metal being harder than the first metal. In another exemplary embodiment, a vertical edge of the wrapper 36 is also hard faced on the inboard side of the compactor wheel 10 to protect the vertical edge of the wrapper 36 in the same manner described above with reference to the circumferential edge 31. The circumferential edge 31 of the wrapper 21 that is hard faced, in a non-limiting embodiment, extends between 0.001 to 3 inches from an edge of the wrapper 37 towards the wrapper outboard side 25. In an even further exemplary embodiment, the hard facing, on either, or both of, the circumferential edge 31 or the vertical edge of the wrapper 36 is 0.001 to 1.5 inches thick.

Referring back to FIG. 4, a wheel fixture 40 is shown. The wheel fixture 40 has a fixture frame 41, a pipe 42, and one or more wheel conical support members 44. The fixture frame 41 is used as a base to support the weight of the fixture and the components of the compactor wheel 10 while it is being assembled, and has a flat bottom to placed on a flat surface. The pipe 42 is a cylindrical tube, with the wheel core 11 being configured to be slidable onto the pipe 42, such that the rim core 13 slides over the pipe 42. The wheel conical support members 44 are placed on the fixture frame 40 and are placed and spaced to support, and hold in place, the inboard or outboard conical members 14, 16 as it rested on the wheel conical support members 44 when the wheel core 11 is placed onto the pipe. The wheel conical members 44 may be any support members configured to hold the inboard or outboard conical members 14, 16 in place, such as brackets or clamps.

The fixture is configured to hold the wheel core 11 in place, allowing the integrated outer wheel assembly 12 to be positioned over the wheel core 11. The wheel fixture 40 is configured to position maintain an axial centerline A-A during the positioning of the integrated outer wheel assembly 12 over the as wheel core 11 as well as necessary axial location. Positioning the integrated outer wheel assembly 12 over the wheel core 11 is when the integrated outer wheel assembly 12 is placed above the wheel core so as the axial centerline A-A of the integrated outer wheel assembly 12 aligns with the axial centerline A-A of the wheel core 11, and the integrated outer wheel assembly 12 is lowered over the wheel core 11 while maintaining the axial centerline A-A alignment.

Once positioned, the integrated outer wheel assembly 12 is secured to the wheel core by joining the integrated outer wheel assembly 12 to the wheel core 11 by welding, or any other attachment means, such as bolting, screwing, or brass fit. In one embodiment the integrated outer wheel assembly 12 is secured to the wheel core 11 by joining the integrated outer wheel assembly 12 to the wheel core 11 at a first interface 45 on the inboard side of the wheel core and the inboard side of the wrapper (welding, or other attachment means, between the inboard conical member 14 and the inboard side of the wrapper 24). Additionally, the integrated outer wheel assembly 12 is secured to the wheel core 11 by joining at a second interface 46 on the outboard side of the wheel core and the inboard side of the wrapper (welding, or other attachment means, between the outboard conical member 16 and the outboard side of the wrapper 25). In one exemplary embodiment, the joining, by welding or other attachment means, at the first or second interface 45, 46 are substantially equidistantly spaced bout the circumference of the wheel core 19. In another exemplary embodiment, the inboard conical member 14 is first placed face down on the wheel fixture 40, the integrated outer wheel assembly 12 is positioned over the wheel core 11 so as the inboard side of the wrapper 24 aligns with the inboard conical member 14, the first interface 45 is joined or attached, the wheel core 11 is lifted off the wheel fixture 40, the outboard conical member 16 is placed down on the wheel fixture 40, and the second interface 46 is joined or attached to complete the compactor wheel 10. In further exemplary embodiment, the outboard conical member 16 is first placed face down on the wheel fixture 40, the integrated outer wheel assembly 12 is positioned over the wheel core 11 so as the outboard side of wrapper 25 aligns with the outboard conical member 16, the second interface 46 is joined, the wheel core 11 is lifted off the wheel fixture 40, the outboard conical member 16 is placed down on the wheel fixture 40, and the second interface 46 is welded to complete the compactor wheel 10.

Figure 7:
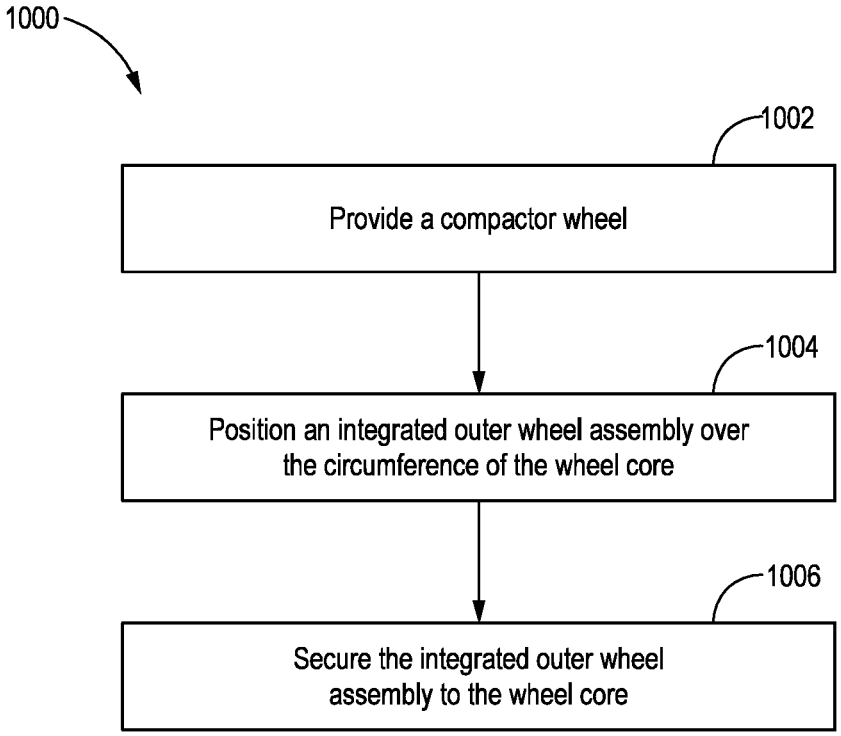
FIG. 7 is a flow chart illustrating a method of remanufacturing a compactor wheel of a compactor vehicle, in accordance with the present disclosure.

FIG. 7 depicts another embodiment of a wheel fixture 60. The wheel fixture 60 includes a base 61, a pipe 62, a plate top 63 supported on the pipe 62, and one or more wheel conical support members 44. This embodiment differs from the wheel fixture 40 in that the plate top 63 is configured to be slidably engageable, without engagement the pipe 62, into the rim core 13.

INDUSTRIAL APPLICABILITY

In general, the teachings of the present disclosure may find applicability in many industries including, but not limited to, landfill waste compaction. More specifically, the teachings of the present disclosure may find applicability in any industry using compactors, such as, but not limit to, in the waste management industry, or any industry of the like compactor vehicles.

In accordance with the scope of the present disclosure, in one such operation it is desirable to remanufacture a compactor wheel, and specifically the outer wrapper and tips of a compactor wheel. Specifically, it is desirable to remanufacture the compactor wheel without a time consuming rebuild process that is labor intensive and requires specialized clamping equipment as well as high capacity press for rolling the outer wrapper. Embodiments described herein provide a pre-fabricated integrated outer wheel assembly that improves efficiencies and maintains compactor wheel diameter and symmetry around its axis.

Turning not to FIG. 7, with continued reference to FIGS. 2-7, a flowchart illustrating an exemplary method 1000 of remanufacturing a compactor wheel of a compactor vehicle is provided. At block 1002, a compactor wheel is provided. The compactor wheel may have a wheel core 11 that is surrounded by a rolled plate wrapper (not shown) having tips (not shown) that is removed by burn through welds from the wheel core 11. The wheel core 11 has an inboard conical member 14 and an outboard conical member 16. A circumference of the inboard conical member 17 and a circumference of the outboard conical member 18 define a circumference of the wheel core 19. The inboard conical member circumference 17 and the outboard conical member circumference 18 may be grinded, or sanded, to polish or smooth them from any residual from the removal of the rolled plate wrapper.

At block 1004, the integrated outer wheel assembly 12 is positioned over the circumference of the wheel core 19. The integrated outer wheel assembly 12 has a hollow cylindrical wrapper 21 that has one or more tips 28 on an outer surface of the wrapper 26, an inboard side 24 and an outboard side 25, and a hard facing 30 on a circumferential edge 31 of the wrapper 21.

At block 1006, the integrated outer wheel assembly 12 is secured to the wheel core 11 at a first interface 45 of the inboard conical member 14 and the inboard side of the wrapper 24 and welding at a second interface 46 of the outboard conical member 16 and the outboard side of the wrapper 25.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

What is claimed is:

1. An integrated outer wheel assembly for a compactor vehicle, the outer wheel assembly including:

a hollow cylindrical wrapper, the wrapper having an inboard side and an outboard side, and one or more tips on an outer surface of the wrapper, wherein the integrated outer wheel assembly is secured to a wheel core, the wheel core disposed on a wheel fixture including a fixture frame, a pipe supporting a plate top, and one or more wheel conical support members, such that the integrated outer wheel assembly is disposed over a circumference of the wheel core and is joined to the wheel core at (i) a first interface of an inboard side of the wheel core and the inboard side of the wrapper, and (ii) a second interface of an outboard side of the wheel core and the outboard side of the wrapper.

2. The integrated outer wheel assembly of claim 1, in which the first interface and the second interface are substantially equidistantly spaced about the outer circumference of the wheel core.

3. The integrated outer wheel assembly of claim 1, in which the wrapper having hard facing on a circumferential edge on the outer surface of the wrapper.

4. The integrated outer wheel assembly of claim 3, in which the wrapper further having hard facing on a vertical edge of the wrapper.

5. The integrated outer wheel assembly of claim 4, in which the hard facing on the circumferential edge and the vertical edge are both on the inboard side of the wrapper.

6. The integrated outer wheel assembly of claim 5, in which the hard facing on the circumferential edge of the wrapper extends between 0.001 to 3 inches from an edge of the wrapper towards outboard side of the wrapper.

7. The integrated outer wheel assembly of claim 5, in which the wrapper is made of a first metal and the hard facing is a weld applied surface treatment of a second metal, the second metal being harder than the first metal.

8. The integrated outer wheel assembly of claim 1, in which there are at least two tips placed in a predetermined pattern on the outer surface of the wrapper.

9. The integrated outer wheel assembly of claim 8, in which the tips are welded to the outer surface of the wrapper.

10. A compactor wheel for a compactor vehicle, the compactor wheel comprising:

a wheel core having a circumference defined by an inboard side and an outboard side of the wheel core, the wheel core disposed on a wheel fixture including a fixture frame, a pipe supporting a plate top, and one or more wheel conical support members; and an integrated outer wheel assembly secured to the wheel core, the integrated outer wheel assembly having:

a hollow cylindrical wrapper, the wrapper having an inboard side and an outboard side, and one or more tips on an outer surface of the wrapper, wherein the integrated outer wheel assembly is secured to the wheel core, the integrated outer wheel assembly is disposed over the outer circumference of the wheel core and the integrated outer wheel assembly is joined to the wheel core at (i) a first interface of the inboard side of the wheel core and the inboard side of the wrapper, and (ii) a second interface of the outboard side of the wheel core and the outboard side of the wrapper.

11. The compactor wheel of claim 10, in which the wheel core comprises a rim core, an inboard conical member, and an outboard conical member.

12. The compactor wheel of claim 11, in which the rim core further has a rim extension configured to cover an axle of a compactor vehicle to keep debris out.

13. The compactor wheel of claim 10, in which the wrapper having hard facing on a vertical edge on the inboard side of the wrapper, and hard facing on a circumferential edge on the outer surface of the wrapper.

14. A method of remanufacturing a compactor wheel of a compactor vehicle, the method comprising:

providing a wheel core having an inboard conical member and an outboard conical member, a circumference of the of inboard conical member and a circumference of the outboard conical member defining a circumference of the wheel core;

positioning an integrated outer wheel assembly over the circumference of the wheel core, the integrated outer wheel assembly having a hollow cylindrical wrapper having one or more tips on an outer surface of the wrapper and an inboard side and an outboard side;

securing the integrated outer wheel assembly to the wheel core by joining the integrated outer wheel assembly and the wheel core at a first interface of the inboard conical member and the inboard side of the wrapper and joining at a second interface of the outboard conical member and the outboard side of the wrapper; and prior to positioning of the integrated outer wheel assembly over the circumference of the wheel core, placing the wheel core on a wheel fixture configured to align the wheel core with the integrated outer wheel assembly, wherein the wheel fixture comprises a fixture frame, a pipe supporting a plate top, and one or more wheel conical support members.

15. The method of claim 14, in which the wheel core is provided by first removing by burn through welds a rolled plate wrapper from the wheel core.

16. The method of claim 15, in which after the rolled plate wrapper is removed, the circumference of the inboard conical member and the circumference of the outboard conical member are smoothed.

17. The method of claim 14, in which the circumferential edge is on the inboard side of the wrapper, and hard facing is also applied to a vertical edge on the inboard side of the wrapper.

* * * * *